United States Patent [19]

Grove

[11] 4,216,869

[45] Aug. 12, 1980

[54] INDUSTRIAL CRANE

[75] Inventor: John L. Grove, Greencastle, Pa.

[73] Assignee: JLG Industries, Inc., McConnellsburg, Pa.

[21] Appl. No.: 835,195

[22] Filed: Sep. 21, 1977

[51] Int. Cl.[2] ..... B66C 23/06

[52] U.S. Cl. ..... 212/165; 212/238; 280/111; 212/253

[58] Field of Search ..... 212/28, 35 R, 37, 38, 212/55, 58 R, 59 R, 65, 69, 35 HC, 48, 49; 280/111; 214/75 H, 77 R; 296/37.1, 37.6; 180/89.1

[56] References Cited

U.S. PATENT DOCUMENTS

| | | | |
|---|---|---|---|
| D. 205,031 | 6/1966 | Grove . | |
| 1,845,161 | 2/1932 | Lewis | 212/38 X |
| 2,374,074 | 4/1945 | Berby et al. . | |
| 2,663,266 | 12/1953 | Baldwin | 280/111 X |
| 2,774,484 | 12/1956 | White . | |
| 2,911,111 | 11/1959 | Grove . | |
| 2,925,149 | 2/1960 | Hughson | 212/49 X |
| 3,021,016 | 2/1962 | Noll et al. . | |
| 3,112,035 | 11/1963 | Knight | 212/35 R X |
| 3,282,441 | 11/1966 | Stauffer . | |
| 3,353,686 | 11/1967 | Cowan | 212/55 |
| 3,498,473 | 3/1970 | Spaulding et al. . | |
| 3,517,829 | 6/1970 | Tax | 212/59 X |
| 3,909,961 | 10/1975 | Lamer et al. | 212/55 X |
| 4,031,976 | 6/1977 | Lambert | 212/141 |

*Primary Examiner*—Robert G. Sheridan
*Attorney, Agent, or Firm*—Irvin A. Lavine

[57] ABSTRACT

An industrial crane has a chassis with a housing mounted on the chassis having a flat, horizontal deck with a central well providing access to a bearing for a rotatable upper works, the bearing being centered on the chassis. The upper works has a portion extending into the well to the bearing. The chassis is supported by four wheels, two of which are on an oscillating axle. The wheels are one size, and extend above the chassis which is between them. The upper works includes a cab, directly over the bearing, a boom support rearwardly of the cab, an engine rearwardly of the boom support, and a lifting boom journalled to the boom support rearwardly of the cab and extending forwardly over the cab. The boom is lifted by a lift cylinder rearwardly of the cab. The boom and the cab, as well as the engine, have their lateral centers in line, along the median plane of the upper works, and the upper works median plane coincides with the chassis median plane when the upper works is forward or rearward.

23 Claims, 6 Drawing Figures

FIG. 2
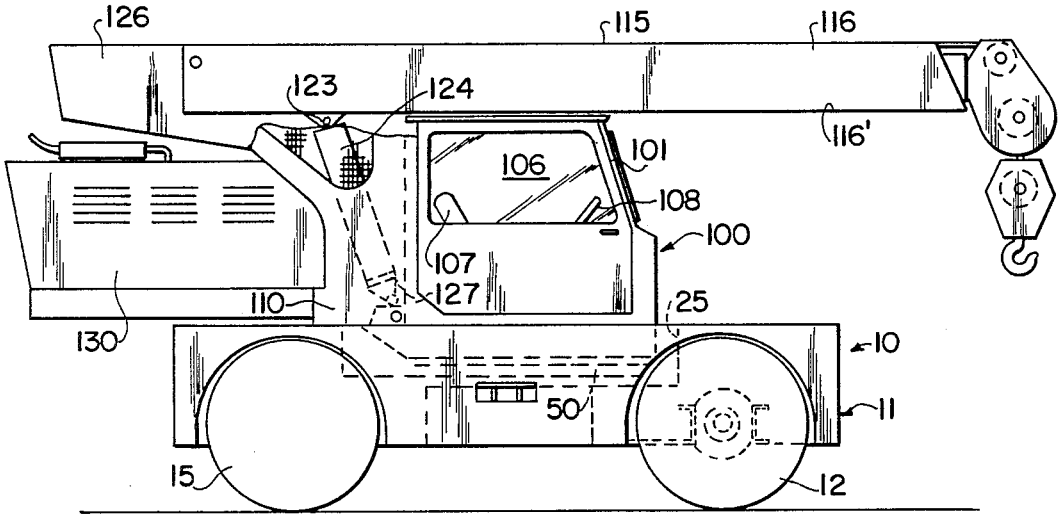
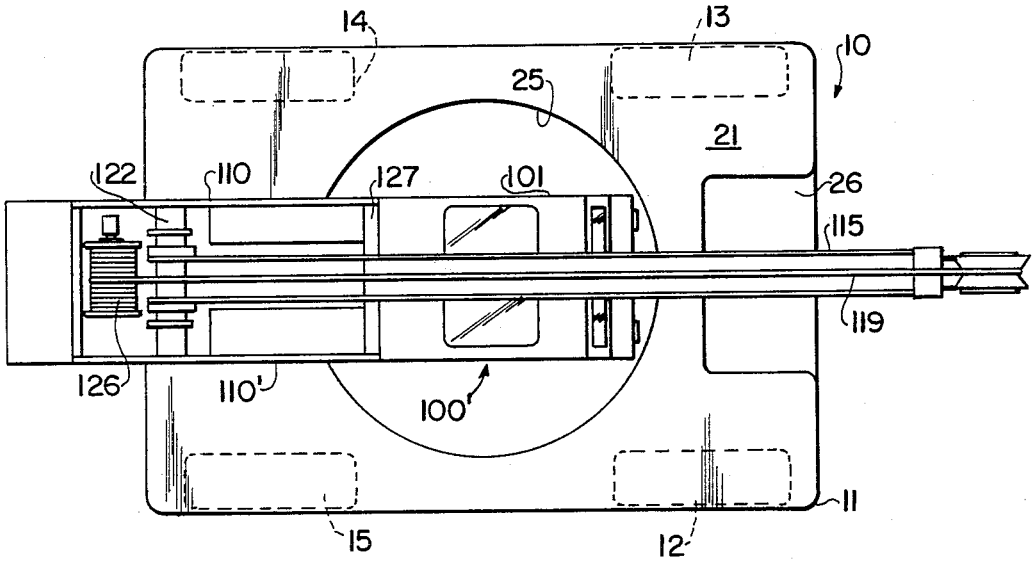
FIG. 3

INDUSTRIAL CRANE

CROSS REFERENCE TO RELATED APPLICATION

This application is related to application Ser. No. 796,437, filed May 12, 1977, by John L. Grove for Truck Mounted Crane and Method of Constructing Same.

BACKGROUND OF THE INVENTION

The present invention relates to cranes which are used for lifting and carrying heavy loads.

Many types of cranes and derricks have been proposed and used. A type of crane which has been widely manufactured has a chassis mounted on four wheels, at least two of which are driven and at least two of which are steerable. An operator's station or cab is provided on the chassis, together with a source of energy which is typically an internal combustion engine. Also mounted on the chassis is a rotatable upper works or turntable, supported on a horizontal bearing carried on the chassis. The upper works includes a boom support structure, which includes a pivot shaft or trunnions on which the boom is journalled. The boom is of telescopic construction, made of plural box sections, and the sections are selectively telescopic, as by one or more hydraulic cylinders. The turntable is rotated by a suitable drive mechanism, and a cable and winch are provided in association with the boom. The operator cab or station includes controls for driving and steering the crane, for rotating the upper works, for raising and lowering the boom, for extending and retracting the boom telescopic section or sections, and for operating the winch.

Grove U.S. Pat. No. 2,911,111 discloses a crane of the above type, in which the turntable is mounted at the front end of the chassis, with the operator's station and engine located near the longitudinal mid-portion of the chassis. Stauffer U.S. Pat. No. 3,282,441 discloses a crane of this construction in which the operator's station is at the front end, the rotatable upper works is mounted at the longitudinal middle of the crane, and an engine is mounted at the rear end. Grove U.S. Pat. No. Des. 205,031 discloses a crane of this type with an operator's cab mounted at the front, the turntable behind the cab and an engine at the rear; when the turntable is positioned so that the boom extends forwardly, it extends over the operator's cab.

A number of cranes have been proposed in which the upper works includes a cab, engine, boom support, and boom. An example is Noll et al U.S. Pat. No. 3,021,016 wherein a crawler-mounted crane has an upper works with a cab above the rotary bearing, an engine rearwardly of the cab, a boom forwardly of the cab, and a super-structure above the cab for raising and lowering the boom, as well as for providing a guide for the cable. White U.S. Pat. No. 2,774,484 is generally similar. Berby et al U.S. Pat. No. 2,374,074 discloses a derrick with a rotatable upper works having a cab in front, a boom support behind the cab, a lattice boom extending forwardly from the boom support, and a derrick structure extending above the cab for supporting the boom. Tax U.S. Pat. No. 3,517,829 is another example of this construction, as is Spaulding et al U.S. Pat. No. 3,498,473.

Other constructions which have been noted include Hamilton et al U.S. Pat. No. 3,601,169, which provides a bearing mounted above the cab structure, with the boom and boom support on an upper works mounted on this bearing, and Gorl et al U.S. Pat. No. 3,885,677, which discloses a heavy duty crane with an operators cab mounted on the chassis, the chassis having a flat deck structure, with a bearing for the upper works on top of the deck structure, and the upper works including a cab mounted beside the boom. Boyer U.S. Pat. No. 3,095,978 provides a truck mounted crane in which the upper works includes an operator's seat, which is laterally offset, there being a lattice-type boom which is non-extensible, a movable support for the base of the boom on the upper works, and an upstanding A-frame structure.

The industrial cranes heretofore provided have required a relatively great height, due to the necessity of positioning the bearing for the upper works at a relatively high level, and the cranes of this type have had the operator's station or cab mounted on the chassis. Consequently, when the upper works has been rotated, the operator has not always been in position to view the load and the area around the load, so as to avoid striking a building or other object with the load, as the load is rotated. Such cranes have, also, been deficient in not providing a flat deck, which would enable loads to be carried directly on the deck.

The derrick type cranes, while providing a cab on the upper works, have required a super-structure or A-frame, for supporting the boom and/or the boom lifting apparatus, and this has resulted in an increase in the height of the structure beyond that which is desirable for industrial type cranes, which are required to operate in some locations having overhead wires or the like which will be interferred with by an exceedingly great height of the crane superstructure. Where mobile cranes have been provided with rotatable upper works including a crane cab, the crane cab has been placed beside the boom, and not beneath the boom, and thereby there has been a resulting obstruction of vision of the operator to one side when the boom is in a lowered position.

SUMMARY OF THE INVENTION

A crane in accordance with the present invention has a chassis supported by four wheels, two of which are mounted on an oscillatable axis, and a housing which covers the four wheels and provides a substantially flat deck of substantial extent, both in the side-to-side direction and in the front-to-rear direction. A bearing for supporting the rotatable upper works of the crane is provided at the longitudinal middle region of the crane, and the deck of the housing is located above the bearing, the deck having an opening or well which extends downwardly to the bearing. The upper works has a portion thereof extending into the well and supported on the bearing, and the upper works has a cab for the operator located at the forward portion, directly above the bearing. The cab is provided with front and side windows, all of which are unobstructed, there being a boom support in the form of a pair of inverted-L-shaped plates which have one leg extending upwardly, and a second leg extending rearwardly, this boom support being rearwardly of the cab. The boom support has a horizontal shaft, on which is pivoted a telescopic boom of box sections, the boom being lifted by a lift cylinder which is positioned rearwardly of the operator's cab and forwardly of the shaft; the lift cylinder is pivotally connected to the underside of the boom. An engine is provided on the upper works, located rearwardly of the upright legs of the boom support, and beneath the horizontal legs thereof, the arrangement being such that the lateral center plane of the cab, the lateral center plane of the boom support structure and the lateral center plane of the boom all coincide, with the engine, also, lying on this plane. When the upper works is in either a fore or aft position, the noted lateral center plane substantially coincides with the lateral center plane of the chassis.

BRIEF DESCRIPTION OF THE DRAWING

FIG. 2 is an elevational view, with parts broken away, of the crane of FIG. 1.

FIG. 3 is a plan view of the crane of FIG. 1.

DESCRIPTION OF THE PREFERRED EMBODIMENT

Figure 1:
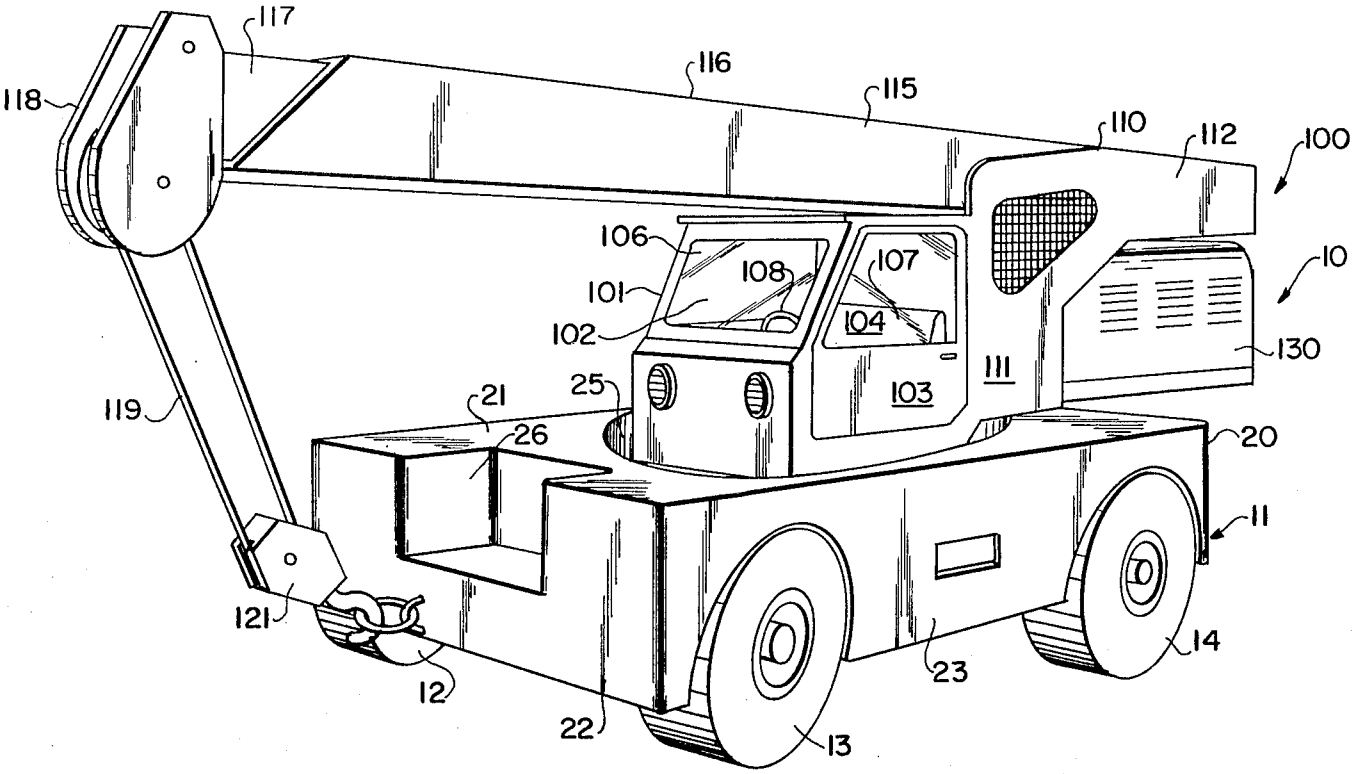
FIG. 1 is a perspective view of a crane in accordance with the present invention.

Referring now to the drawings, wherein like or corresponding reference numerals are used to designate like or corresponding parts throughout the several views, there is shown in FIG. 1 a crane generally designated 10, including a vehicular portion 11, including wheels 12, 13 and 14, with a fourth wheel not shown in FIG. 1. The vehicular portion includes a generally parallelepipedal housing 20 which includes a flat upper deck 21, a flat front end 22 perpendicular thereto, and a flat side 23, it being understood that the rear end, opposite the front end 22, is also flat, and that the side opposite the side 23 is also flat. The deck 21 has a well 25 therein, which is centrally located in both the longitudinal or fore and aft direction, and in the side-to-side or transverse direction. In addition, there is preferably provided a recess 26 at the front of the housing 20, so that objects may be supported therein, the flat deck 21 being provided for the support of such objects as may be required. The flat deck may be seen to lend itself to the provision of suitable brackets or other holding devices, as may be desirable in connection with a particular useage of the crane 10.

A rotatable upper works, generally designated 100 is provided, and includes a cab 101 having a front window 102 and a side door 103, with a window 104 therein. Opposite door 103 is a door including a window 106. The cab 101 includes an operator's seat 107, a portion of which may be seen through the window 104, and there is also provided in the cab 101 a number of controls, including a steering wheel 108. There are also provided in the operator's cab 101 conventional controls for cranes of this type, including controls for driving, steering and braking the vehicular portion 11, as well as controls for rotating the upper works 100, for raising and lowering the boom, for extending and retracting the boom, and for operating a winch associated with the boom.

Rearwardly of the cab 101 is a boom support, in the form of a pair of parallel boom support plates, a single boom support plane 110 being shown in FIG. 1, and comprising a first leg 111 which extends generally upwardly, and a second leg which extends generally rearwardly and horizontally, from the upper end of the first, generally vertical leg 111. The boom support includes a boom pivot shaft for pivotally supporting the boom 115, which is of telescopic construction, having a base section 116 and a fly section 117. The fly section 117 may be caused to telescope in and out by suitable means, such as a hydraulic cylinder (not shown). The fly section 117 carries at its outer end a boom nose 118, and a cable 119 extends downwardly from the nose 118, to a block 121. The boom 115 may have more than two sections, and is made of sections of box construction, being in the form shown of hollow rectangular construction in transverse cross section. Each of the boom sections is made up, there fore, of an upper and a lower plate, and a pair of side walls.

A source of energy is provided on the upper works 100, rearwardly of the first leg 111 of the boom support plate 110, and beneath the second leg 112 thereof. The source of energy is housed within the compartment 130, and is preferably an internal combustion engine.

Referring now to FIG. 2, there may be seen the crane 10 with the vehicular portion 11, and the upper works 100. The vehicular portion 11 is shown, with the well 25, and a portion of the upper works 100 extending into the well 25, rotatably mounted on a bearing 50. On the upper works 100, the window 106 is shown, forming a part of the operator's cab 101. The steering wheel 108 and seat 107 are also shown, and the view of the operator left, right and forward is unobstructed.

The right hand boom support plate 110' is identical to the boom support plate 110, and is shown broken away. A horizontal boom pivot shaft 122 extends from and is carried by the plates 110 and 110', and rearwardly of cab 101 and the boom 115 is journalled thereon. Forwardly of the shaft 122 is a pivotal connection 123 between the boom 115 and a lift cylinder 124. Lift cylinder 124 is rearwardly of cab 101, and between cab 101 and the shaft 122. Actuation of lift cylinder 124 will cause the boom 115 to pivot on shaft 122. Rearwardly of the rear end of boom 115 there is mounted a winch 126 on which the cable 119 is wound. The boom base section 116 comprises a bottom plate 116' which extends from the front of boom base section 116 rearwardly past the pivotal connection 123 and the boom pivot shaft 122. Thus, the bottom of the boom base section 116 is a solid, unbroken plate.

Referring now to FIG. 3, there may be seen the crane 10 in plan view, there being shown the flat, horizontal deck extending from front to rear and side to side, broken by the well 25, and also, preferably, by the recess 26. The upper works is positioned in the fore and aft direction, so that the cab 101 faces directly to the front. The boom 115 will be seen to pass directly over the cab 101, being narrower than cab 101. The lateral center plane of cab 101, the lateral center plane between the boom support plates 110 and 110', and the lateral center plane of boom 115 are common to each other. Thus, the boom and the cab are centered in the lateral sense relative to each other. In addition, the entire upper works 100 has a central plane which coincides with or is common with the central plane of the vehicular portion 11 of crane 10. That is, the upper works 100 is centered on the vehicular portion 111 in the transverse direction, and, as is shown in FIG. 2, the bearing 50 which rotatably supports the upper works 100 is located adjacent the center of the vehicular portion 111 of crane 10, and particularly of the chassis thereof. The operator's cab 101 will be seen in FIGS. 2 and 3 to be above the bearing 50, with the axis of bearing 50 passing through cab 101. As may be seen from FIG. 3, the boundaries of cab 101 are within the opening of the deck 21 provided for the well 25.

A boom safety stop 127 extends in a generally vertical plane rearwardly of the cab 101, and up to approximately the level of the top of cab 101, so as to obviate any danger to the operator from a lowering of the boom 115 beyond its intended lower limit, which is the horizontal position shown in FIG. 2.

Figure 4:
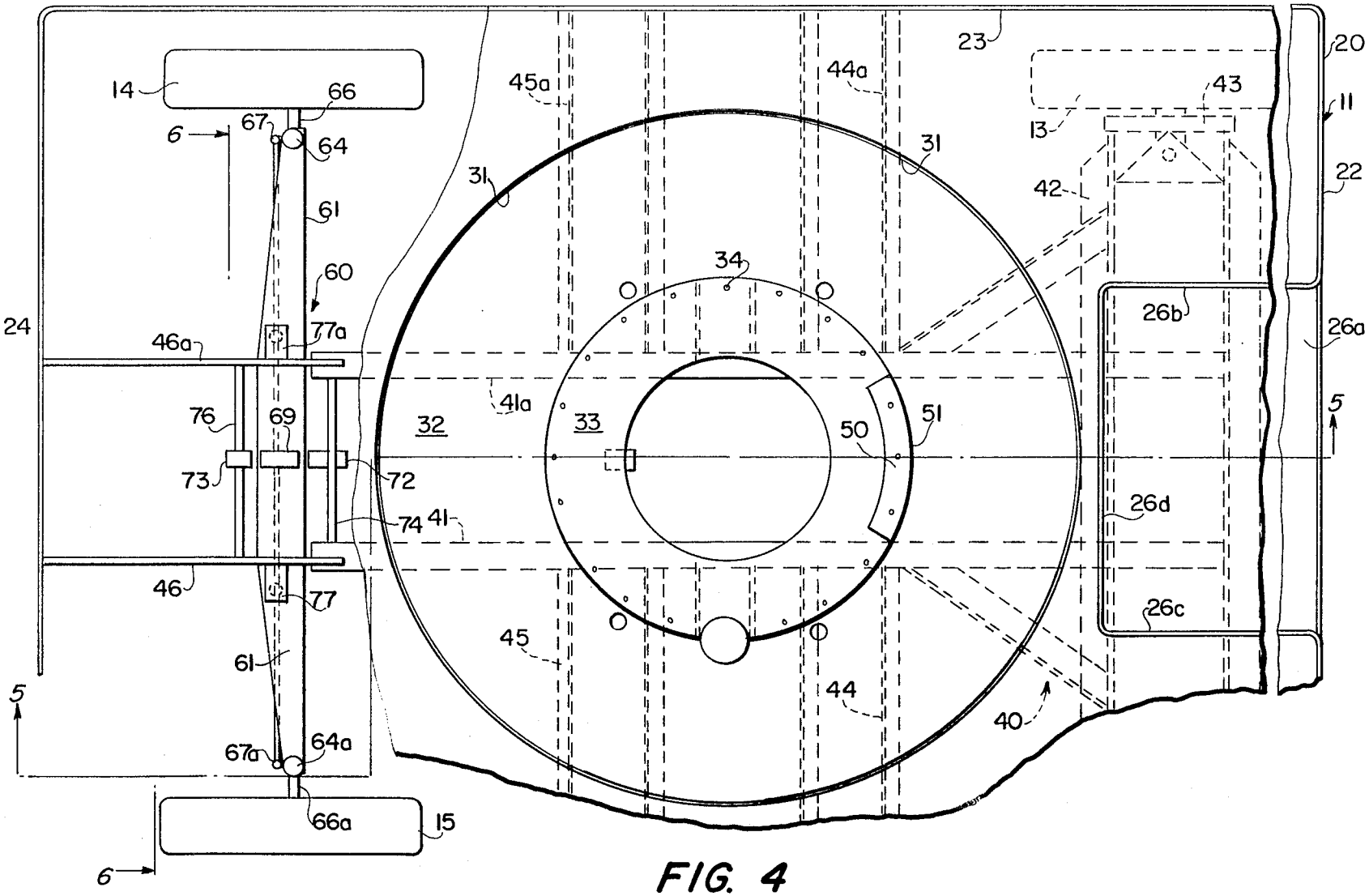
FIG. 4 is a plan view, with the upper works and other parts removed.

Referring now to FIG. 4, there is shown the vehicular portion 11. The housing 20 of modified parallelepipedal shape includes the front end 22, the flat side 23 and the rear end 24. All are in vertical planes, with the flat side 23 being perpendicular to the front and rear ends 22 and 24. The deck 21 is shown partially broken away, being flat, and interrupted by the well 25 and the recess 26. The well 25 includes a cylindrical wall 31 (see also FIG. 5) having at its bottom an annular horizontal plate 32. An annular bearing mounting plate 33 is radially inwardly of the annular plate 32, being provided with a circular array of holes 34 for mounting a rotary bearing thereon. One race of the rotary bearing 50 is partially shown in FIGS. 4 and 5 and the remainder is broken away. On the outer periphery of the outer race of bearing 50 is a ring gear 51, and it will be understood that a second race of the bearing 50 is secured to the upper works 100, and that the upper works 100 contains a gear (not shown) which meshes with the ring gear 51. This provides the rotary mounting and drive for the upper works 100, and is substantially as shown in Hamilton et al U.S. Pat. No. 3,601,169.

The recess 26 includes a horizontal bottom wall **26*a*, a pair of vertical side walls 26*b* and 26*c*, and a vertical rear wall 26*d*. The recess is centrally located in the lateral direction, and is between a pair of wheels, specifically the wheels 12 and 13 as shown in FIG. 1. As is clearly shown in FIG. 5, the bottom plate 26*a* is below the deck 21**, and is parallel to it.

A chassis generally designated 40 is provided, and as seen in FIG. 4 comprises a pair of spaced parallel and longitudinally extending chassis members 41, **41*a* and a front transversely extending chassis member 42. The front transverse chassis member 42 is a part of a front boxlike structure which includes a hub 43 having a central opening 43*a* for mounting a fixed axle which supports the wheel 13. The supporting structure for the wheel 12 at the right front of the vehicular portion 12** is similar and symmetrical.

In addition, there are provided transverse chassis members 44 and 45, extending from the longitudinal chassis member 41, and similar transverse chassis members **44*a* and 45*a* extend from longitudinal chassis member 41*a*. It is to the outer ends of these latter chassis members that the side plates of the housing 20 are secured. The annular plate 32 (FIG. 5) of housing 20 is secured to the top of the chassis 40, particularly to the upper surfaces of the longitudinal chassis members 41, 41*a*, and to the upper surfaces of the chassis members 44, 44*a* and 45, 45*a***.

Figure 6:
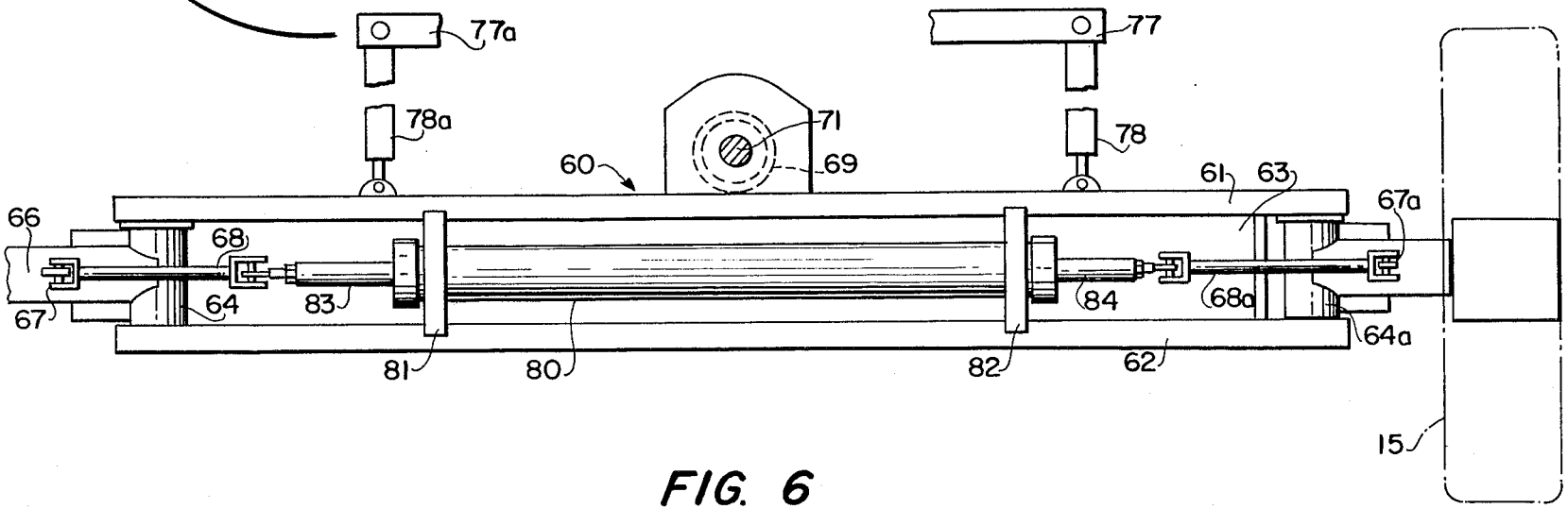
FIG. 6 is a view taken generally on the line 6—6 of FIG. 5, and showing an oscillating axle construction.

At the rear, the rear wheels are supported on an oscillating axle generally designated 60, which is mounted for oscillating movement about a horizontal axis extending parallel to the longitudinal chassis members 41, 41*a*, the axle 60 supporting steerable wheels at the end thereof. Referring to FIGS. 4 and 6, the oscillating axle 60 includes a horizontal upper plate 61 and a horizontal lower plate below it and connected to it by a vertical plate 63. A vertical wheel pivot shaft 64, **64*a* is journalled in a suitable bearing structure (not shown) which comprises suitable aligned openings in the upper and lower axle plates 61 and 62, adjacent the outer ends thereof. As shown in FIG. 4, the journal has a spindle 66 extending from it, which supports the wheel 14. A control arm 67** extends radially from the journal, and forms part of steering linkage.

Figure 5:
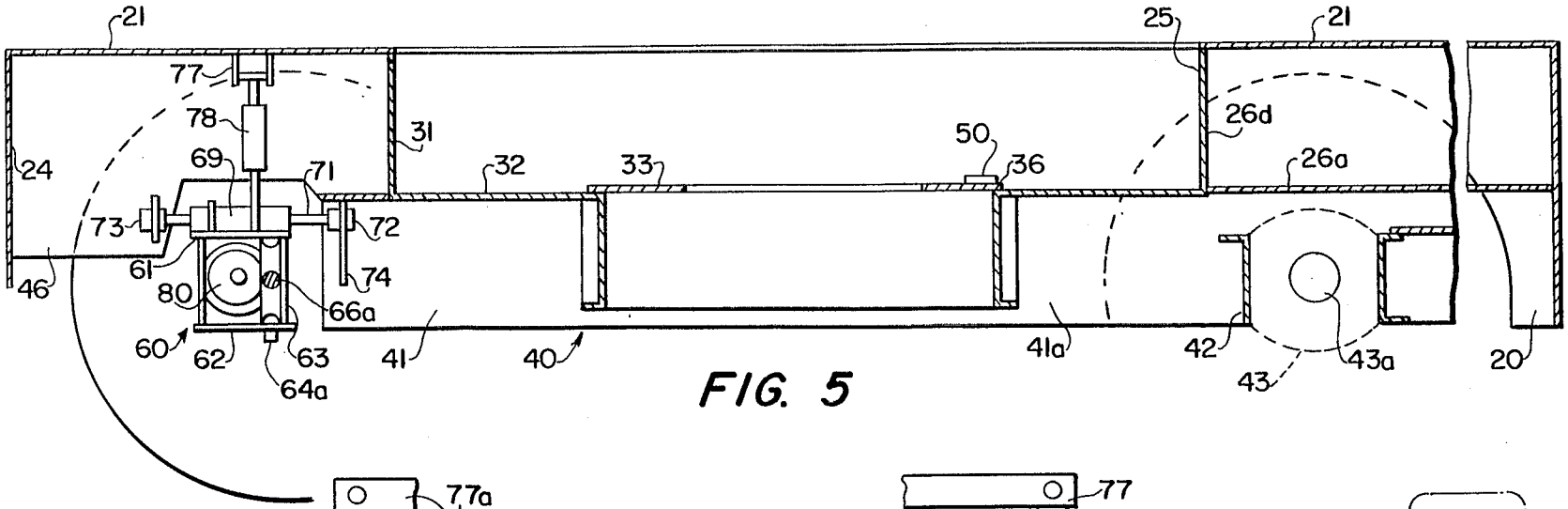
FIG. 5 is a cross sectional view taken on the line 5—5 of FIG. 4.

The oscillating axle 60 is supported by a bearing 69 which is secured, as by welding, on the top of upper plate 61 of axle 60, and is centrally located intermediate the ends of axle 60. A shaft 71 extends through the bearing 69, and is supported at its forward end by a front support bearing 72 and at its rearward end by a rear support bearing 73. The front support bearing 72 is carried in a plate 74 which extends between and is joined to the longitudinal chassis members 41 and **41*a*. A pair of frame extensions 46 and 46*a* are joined to the chassis members 41 and 41*a*, respectively, and extend rearwardly, passing over the axle 60 as shown in FIG. 5. Extending between the frame extensions 46 and 46*a* is a rear bearing support plate 76, which supports the rear support bearing 73. As noted, the shaft 61 extends through the bearings 69, 72 and 73, and supports the axle 60** for oscillating movement about an axis as described.

The frame extensions 46 and **46*a* extend rearwardly, as shown in FIG. 4, and have the plate forming the rear end 24 of housing 20 secured to them. As will be understood, FIG. 4 is illustrative, and various gusset plates and other reinforcing and strengthening elements are omitted for clarity. As shown in FIG. 5, the frame extension 46, and frame extension 46*a* (not shown) extend upwardly and have their upper edges horizontal and coplanar, the portion of the deck 21 which extends forwardly from the rear end 24 being supported on these upper horizontal edges of the frame extensions 46 and 46*a*. As shown in FIG. 4, the frame extensions 46 and 46*a* have anchors 77 and 77*a* extending outwardly from them, FIG. 5 showing the anchor 77 to be in the form of a pair of vertical plates which extend downwardly from beneath the deck 21**.

Steering movement of the wheels supported by oscillating axle 60, as shown in FIG. 6, is effected by a double acting hydraulic cylinder 80 which is secured in a horizontal position on the axle 60 by a pair of brackets 81 and 82. Piston rods 83 and 84 extend from the ends of the hydraulic cylinder 80, and are connected to the control arms 67 and **67*a* by linkage 68, 68*a* which may include pivoted joints in conventional manner. A hydraulic pump and valves (not shown) are connected to the cylinder 80 to effect movement of the piston therein in one direction or the other, to effect steering movement in known manner. Thus, the wheel 14 (FIG. 5) and the wheel 15 (FIG. 6**) are turned together in the same direction and similar amount.

When the crane 10 is driven, as a vehicle, the axle 60 may pivot or oscillate as necessary on the axis of the shaft 71. When, however, the industrial crane 10 is used for lifting loads, it is desirable to negate such oscillating movement, and this is accomplished by a pair of lock out cylinders 78 and **78*a*, which, as shown in FIG. 6, extend between the upper plate 61 of axle 60 and the anchors 77 and 77*a*, respectively. When the axle 60 is to be fixed, that is, its oscillating movement locked out, suitable valves (not shown) prevent movement of fluid into or out of the lock out cylinders 78 and 78*a***, in conventional manner, and during transit, the fluid is permitted to flow in and out of the lock out cylinders 78 and 78*a* to permit the noted oscillating movement of axle 60.

The crane 10 is hydraulically driven and operated. The internal combustion engine in the compartment 130 drives a pump, which is connected by fluid lines through control valves in the cab 101 to various motors. These hydraulic lines extend, for example, to hydraulic drive motors carried by the first wheels 12 and 13, and to the steering cylinder 80 to effect steering. The hydraulic pump, through lines controlled from cab 101, will drive a fluid motor to effect rotation of the upper works 100, and will actuate the lift cylinder 124 as desired, as well as the boom extension cylinder (not shown) for extending and retracting the telescopic boom 115. Also, controls provide for operation of the winch 126 to raise and lower loads.

The upper works 100 rotates on the bearing 50, and the boundaries of the cab are within the well 25 in deck 21.

The crane 10 herein disclosed has the load always directly in front of the operator in the cab 101, and the view of the operator is completely unobstructed both forward, and to the sides. The engine in compartment 130 provides a counterbalancing weight for the load, and the crane 10 is able to lift substantially the same loads over the front, rear, or either side, for a given boom angle and extension. This characteristic is due in part to the placement of the center of the bearing 50 equally distant from the axis through the front wheels 12 and 13 on the one hand and the rear wheels 14 and 15 on the other hand. The wheels have their upper portions at or above the chassis 40 when the crane 10 is on level terrain, and on uneven terrain, the axle 60 pivots, raising one wheel or the other higher relative to the position of the wheel when the crane is on level terrain. This movement is permitted by the height of deck 21 over the chassis 40, and over the highest position of the wheels when axle 10 oscillates.

The deck 21 is flat from the well 25 to locations over the four wheels of the crane 10. The provision of the flat deck 21 enables the crane to carry various materials or loads on the deck, and this ability is enchanced by the recess 26, which may be provided to accommodate additional objects.

It will be obvious to those skilled in the art that various changes may be made without departing from the spirit of the invention, and therefore the invention is not limited to what is shown in the drawings and described in the specification but only as indicated in the appended claims.

I claim:

1. An industrial crane comprising:

(a) a chassis, wheels for supporting said chassis, bearing means on said chassis for rotatably supporting an upper works, and (b) an upper works on said bearing means comprising: a cab located at the front of said upper works, said cab comprising control means, an operator's seat, and having front and side windows, boom support means behind said cab, a boom pivoted on said boom support means and extending forwardly over said cab, lift cylinder means behind said cab and below said boom for raising said boom, a source of energy behind said lift cylinder means, said cab, boom support means and boom being laterally centered on said upper works, crane upper works elements which extend above said windows other than said boom being rearwardly of said cab.

whereby to provide unobstructed vision for an operator in said seat in said cab forwardly, to both sides, and rearwardly over both shoulders.

2. An industrial crane as set forth in claim 1, wherein said bearing means is at a level below the tops of said wheels.

3. An industrial crane as set forth in claim 2, and deck means on said chassis having a planar upper surface above said wheels, and an opening in said deck means above said bearing means, said upper works extending through said opening to said bearing means.

4. An industrial crane as set forth in claim 2, said wheels comprising pneumatic tires.

5. An industrial crane as set forth in claim 2, wherein said boom has a horizontal position in which the bottom of the boom is in closely spaced relation above the top of the cab, said boom support means being substantially the highest part of said crane when said boom is in horizontal position.

6. The crane of claim 1, wherein the center of said bearing means is substantially adjacent the center of said chassis.

7. The crane of claim 6, wherein said operator's cab is above said bearing means with the axis of said bearing means passing therethrough.

8. The crane of claim 1, wherein said operator's cab is above said bearing means with the axis of said bearing means passing therethrough.

9. The crane of claim 1, wherein said boom support comprises a pair of spaced, parallel support elements, one on either side of said upper works, each said support element having a first leg extending upwardly from the bottom of said upper works rearwardly of said cab, and a second leg extending rearwardly from the upper part of said first leg.

10. The crane of claim 9, wherein said source of energy is located on said upper works rearwardly of said first legs, and at a level lower than said second legs of said boom support.

11. An industrial crane comprising:

a chassis including generally horizontal bearing means thereon, means supporting said chassis comprising two pairs of longitudinally spaced wheels, said wheels extending above the chassis and above said bearing means, a housing comprising deck means supported on said chassis and having a planar surface located at a level above said bearing means and above said wheels, an opening in said deck means above said bearing means, a rotatable upper works extending through said opening in said deck means and supported on said bearing means, said rotatable upper works comprising a boom surrport, a cab and a boom.

12. The industrial crane of claim 11, wherein the boundaries of said cab are within said opening in said deck means.

13. The crane of claim 11, wherein said chassis comprises a pair of spaced longitudinally extending frame members, and transverse frame members having their upper surfaces coplanar, said bearing means mounted substantially at the level of said frame member upper surfaces.

14. The industrial crane of claim 11, and an axle extending transversely of said chassis and supporting one said pair of wheels, and means mounting said axle on said chassis for pivoting movement about a horizontal, fore and aft axis.

15. The industrial crane of claim 11, wherein said deck means comprises a substantially flat, horizontal surface extending from end to end and side to side of said chassis.

16. The industrial crane of claim 15, wherein said deck means has a recess therein at one end, said recess having a horizontal plate at a level lower than said deck means.

17. The industrial crane of claim 11, wherein said bearing means is located substantially adjacent the center of said chassis.

18. The industrial crane of claim 17, wherein said cab is located over and above said bearing means.

19. The industrial crane of claim 18, wherein said boom support has a shaft rearwardly of said cab, and wherein said boom extends forwardly from said shaft directly over said cab.

20. A mobile industrial crane comprising:

a chassis, supporting wheels at the front and rear of said chassis, and extending above the level of the top of the chassis, bearing means supported by said chassis in a substantially horizontal plane at the level of the top of the chassis, an upper works rotatably supported on said bearing means and extending upwardly from said bearing means, said upper works commprising an operator's cab laterally centered on said upper works and over said bearing means, boom support means behind said operator's cab, a boom carried by said boom support means and extending over said operator's cab, means behind said cab for raising said boom, and a source of energy rearwardly of said boom support means.

21. The industrial crane of claim 20, wherein said upper works rotates on a vertical axis through said bearing, and wherein said axis passes through said cab.

22. The industrial crane of claim 20, and deck means supported on said chassis and located at a level above said bearing means and above said wheels.

23. An industrial crane comprising:

a chassis having an upper surface and including generally horizontal bearing means thereon substantially at said upper surface, wheels supporting said chassis and extending above said bearing means, a housing supported on said chassis and comprising deck means located at a level above said bearing means, said deck means extending over said wheels, an opening in said deck means above said bearing means, a rotatable upper works supported on said bearing means and having a portion extending through said opening in said deck means to said bearing means, said rotatable upper works comprising a boom support, a cab and a boom.

* * * * *